United States Patent [19]

Hayashi et al.

[11] Patent Number: 4,680,874

[45] Date of Patent: Jul. 21, 1987

[54] DEVICE FOR EXTRACTING WATER FROM A LOAD OF WASHED ARTICLES

[75] Inventors: Shoichi Hayashi; Hidetoshi Ishihara; Taketoshi Okada; Kunio Kojima, all of Nagoya, Japan

[73] Assignees: Mitsubishi Jukogyo Kabushiki Kaisha, Tokyo; Churyo Engineering Co., Ltd., Aichi, both of Japan

[21] Appl. No.: 869,899

[22] Filed: Jun. 3, 1986

[30] Foreign Application Priority Data

Jul. 26, 1985 [JP] Japan ..... 60-114999[U]
Sep. 18, 1985 [JP] Japan ..... 60-204524
Sep. 27, 1985 [JP] Japan ..... 60-147910[U]

[51] Int. Cl.[4] ..... F26B 9/04

[52] U.S. Cl. ..... 34/143; 34/146; 68/21; 68/242

[58] Field of Search ..... 34/145, 143, 146; 68/241, 242, 19.1, 21

[56] References Cited

U.S. PATENT DOCUMENTS

| | | | |
|---|---|---|---|
| 3,924,425 | 12/1975 | Arendt | 68/242 |
| 4,249,400 | 2/1981 | Arendt | 68/242 |
| 4,452,056 | 6/1984 | Files | 68/242 |
| 4,471,637 | 9/1984 | Holzinger | 34/145 |
| 4,575,949 | 3/1986 | Bernecker | 68/242 |

*Primary Examiner*—Larry I. Schwartz
*Attorney, Agent, or Firm*—Wenderoth, Lind & Ponack

[57] ABSTRACT

A device for extracting water from a load of articles which have been washed uses fluid pressure to exert a force on the load. A system controls the fluid pressure such that only low pressure is applied to the load for a predetermined period of time at the beginning of the water extracting operation. Subsequently, the load is subjected to a high pressure exerted by the fluid.

4 Claims, 18 Drawing Figures

DEVICE FOR EXTRACTING WATER FROM A LOAD OF WASHED ARTICLES

BACKGROUND OF THE INVENTION

1. Field of the Invention

This invention relates to a device for extracting water from clothes, etc. which have been washed.

2. Description of the Prior Art

A typical device of this type known in the art is shown in FIG. 17. It is the device disclosed in Japanese Patent Application No. 25594/1964. It includes a main housing not shown, and has a base 1 installed on a floor. A pneumatic cylinder 2 is secured to the base 1 and includes a piston rod having a conical head. A bogie 3 has a plurality of wheels each equipped with a cushion. A cylindrical jacket 4 is open at both of its upper and lower ends and comprises a cylindrical wall having a multiplicity of apertures. extending therethrough. A hydraulic cylinder 5 is secured to the main housing above the jacket 4 and includes a piston rod carrying a pressing disk 6 at its lower end. A pneumatic cylinder 7 is suspended from the main housing by a pin 8 about which it is rotatable. Another pneumatic cylinder 9 is rotatably supported by a pin 10 on the main housing and includes a piston rod hinged to the cylinder 7 by a pin 11. The device further includes another pneumatic cylinder 12 secured to the main housing.

The jacket 4 is placed on the bogie 3 and the clothes or similar articles 13 which have been washed are put into the jacket 4. The bogie 3 is moved onto the base 1 until it engages a stopper not shown. The bogie 3 has a conical recess at its bottom. The pneumatic cylinder 2 is actuated to raise the piston rod and move its conical head into the conical recess of the bogie 3 to hold the bogie 3 in position. Then, the hydraulic cylinder 5 is actuated to lower the pressing disk 6 into the jacket 4 to press the articles 13 against the bogie 3, so that water may be extracted from the articles 13. When the articles 13 are pressed against the bogie 3, the flexure of the cushions on the bogie 3 allows it to rest on the base 1. The piston rod of the cylinder 2 is also lowered, as it is pushed down by the bogie 3.

Then, the pneumatic cylinder 9 is actuated to move the pneumatic cylnder 7 to its vertical position and the cylinder 7 is actuated to lower its piston rod. The jacket 4 has a lug 4*a* projecting from its outer surface. The piston rod of the cylinder 7 which has been lowered is engaged with the lug 4*a*. Then, the hydraulic cylinder 5 is actuated to raise the pressing disk 6 slightly to facilitate the movement of the jacket 4 relative to the articles 13. When the pressing disk 6 has been raised, the bogie 3 is moved away from the base 1 by the cushions. Then, the pneumatic cylinder 7 is actuated to raise the jacket 4 until its lower end reaches a level of height which is equal to, or slightly above, that of the pressing disk 6.

Then, the pneumatic cylinder 12 is actuated to advance its piston rod and thereby push the articles 13 away from the bogie 3. After its piston rod has been retracted, the pneumatic cylinder 7 is actuated to lower the jacket 4 onto the bogie 3 and its piston rod is disengaged from the lug 4*a* on the jacket 4. After the cylinder 7 has been actuated to raise its piston rod, the cylinder 9 is actuated to return the cylinder 7 to its inclined position as shown in FIG. 17. At the same time, the hydraulic cylinder 5 is actuated to raise the pressing disk 6 to a level above the jacket 4. The device is now ready to receive another bogie and another jacket filled with new articles to be dried.

FIG. 18 is a graph showing by way of example the relation between the length of time for which pressure is applied to the articles to be dried in the device as hereinabove described and the amount of pressure which the articles receive. A hydraulic fluid is supplied from a source not shown to the hydraulic cylinder 5 to cause the pressing disk 6 to press the articles 13. The articles which have been washed contain large amounts of water and air. In the absence of any sufficient preliminary compression, the water or air which the articles contain has a sudden rise in pressure and damages the articles.

The device is used for drying a wide variety of articles, including clothes, bed sheets, towels and bathrobes, made of different materials, such as 100% cotton and a mixture of cotton and synthetic fibers. The life of the articles depends on the way in which pressure is applied thereto to extract water therefrom, and the optimum pressure application differs from one kind of article to another. This difference is, however, not taken into account by any conventional device.

SUMMARY OF THE INVENTION

It is an object of this invention to provide a device which can extract water from a load of wet wash under pressure without doing any damage thereto so that the washed articles may have a prolonged life.

This object is attained by a device for extracting water from the load of wash by means of fluid pressure which is induced by means for controlling the fluid pressure so that the wash may receive a lower pressure for preliminary compression for a predetermined period of time during the beginning of the water extracting operation than thereafter.

The flow of the hydraulic fluid which is supplied into a hydraulic cylinder through a pump is detected so that its pressure may not exceed a predetermined level for a predetermined period of time. Should its pressure exceed the predetermined level, the fluid is caused to flow into a fluid reservoir.

Other objects, features and advantages of this invention will become apparent from the following detailed description and the accompanying drawings.

DETAILED DESCRIPTION OF THE INVENTION

Figure 1:
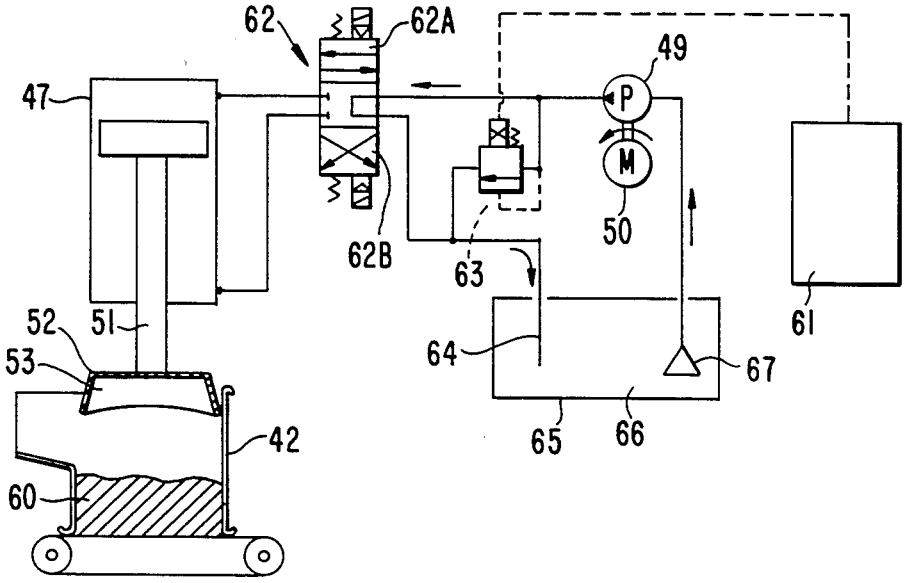
FIG. 1 is a diagram showing a hydraulic circuit in a device according to a first embodiment of this invention.

The invention will now be described in detail with reference to the drawings.

(1) First Embodiment:

Reference is made to FIGS. 1 to 5. A substructure 36 is installed on a floor and includes a plurality of pillars 37. A lattice deck 38 is secured to the substructure 36. A perforated deck plate 39 is secured to the deck 38. An endless belt 40 having a relatively large width extends between a pair of rolls 41 for conveying a load of washed articles. The belt 40 is perforated or is fabricated from a network so that water may pass therethrough. A basket 42 has a cylindrical lower portion formed from a perforated plate. The basket 42 has at its top an opening 43 through which a load of washed articles is introduced into the basket 42. A plurality of guide members 44 project from the basket 42 and engage the pillars 37.

A mechanism for raising or lowering the basket 42 is secured to the substructure 36 and is connected to the basket 42 by a chain, etc. A hydraulic cylinder 47 is secured to the substructure 36 and includes a piston rod 51. A hydraulic system 48 includes a fluid reservoir and a hydraulic circuit for the hydraulic cylinder 47. A hydraulic pump 49 is provided for the hydraulic system 48 and is driven by a motor 50. The piston rod 51 carries a bowl-shaped member 52 at its lower end. An elastic membrane 53 closes the opening of the bowl-shaped member 52 so that the latter may hold water 56 therein. A member 54 for supplying water and a member 55 for discharging air are connected to the bowl-shaped member 52. The membrane 53 is secured to the bowl-shaped member 52 by a ring 57 which is bolted to the latter.

A continuous washing machine is shown at 58. A conveyor 59 is provided for delivering a load of washed articles 60 to a drying machine, etc. after water has been extracted therefrom by the device of this invention. The load 60 consists of at least one article of clothing that has been washed by the washing machine 58.

Referring to FIG. 1, a pressure controller 61 is provided for varying the pressure which is applied to the load of washed articles to extract water therefrom, progressively from one of a plurality of predetermined levels to another with the lapse of time set by a timer not shown so that a predetermined relation may be established between the pressure and the time. It may, for example, comprise a proportional solenoid valve or a control valve. A directional control valve 62 is provided for supplying hydraulic fluid 66 into the upper or lower end of the hydraulic cylinder 47 through the pump 49 to lower or raise the piston rod 51. The valve 62 has an upper portion 62A which when positioned in the fluid circuit is used to lower the piston rod 51 to apply pressure to the load of washed articles 60 to extract water therefrom. If the lower portion 62B of the valve 62 is positioned, the piston rod 51 is raised.

A servo valve 63 is provided for bypassing the hydraulic fluid 66 from the pump 49 to a return line 64 leading to the fluid reservoir 65 in response to a signal from the pressure controller 61 to prevent the pressure being applied to the load of washed articles from rising above a predetermined level. A suction filter 67 is provided in the fluid reservoir 65 for removing foreign matter from the hydraulic fluid 66 reaching the pump 49.

Figure 3:
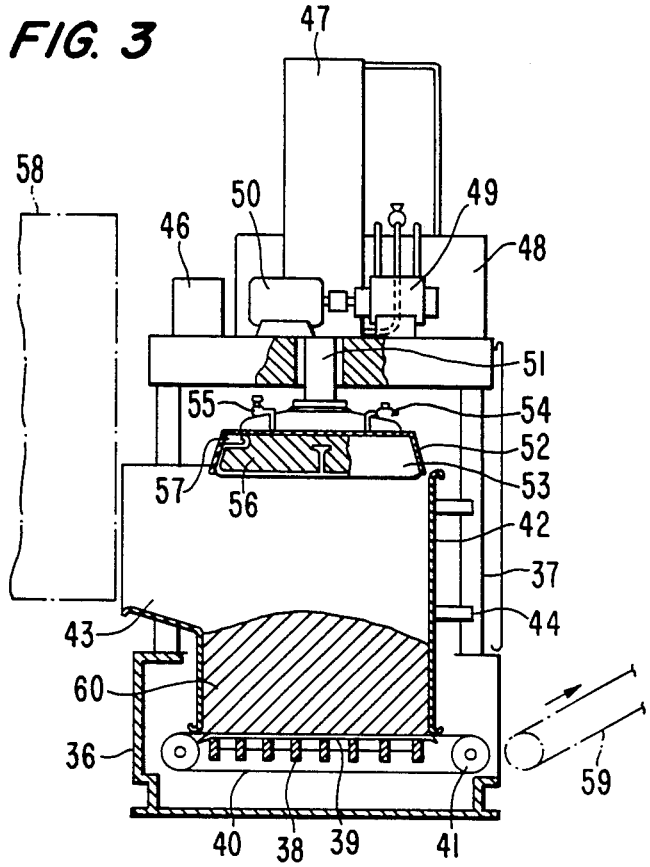
FIG. 3 is a detailed side elevational view, partly in section, of the device shown in FIG. 1.
Figure 4:
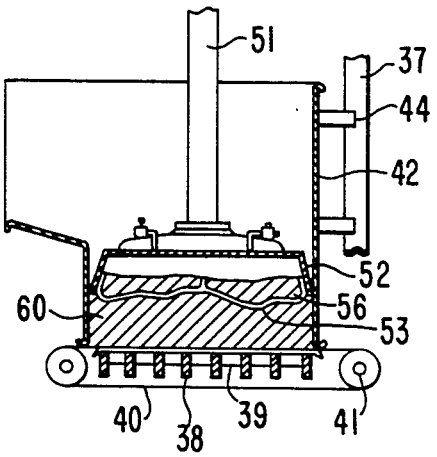
FIGS. 4 and 5 are fragmentary side elevational views, partly in section, showing the device of FIG. 3 in different operating positions.

In operation, the basket 42 staying in its lowered position receives the load of washed articles 60 from the continuous washing machine, while the belt 40 is out of operation and the piston rod 51 is in its raised position, as shown in FIG. 3. The hydraulic system 48 is started in response to a signal from the washing machine 58 which indicates that it has supplied the basket 42 with an appropriate amount of washed articles 60. The piston rod 51 is lowered and the membrane 53 presses the load of washed articles 60, as a result of the positioning of the upper portion 62A of the directional control valve 62 which causes the hydraulic fluid 66 to flow into the upper end of the cylinder 47.

Figure 2:
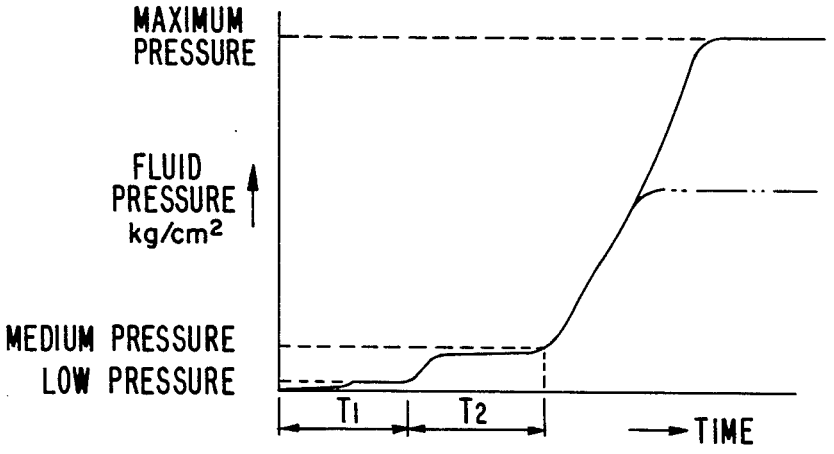
FIG. 2 is a graph showing by way of example the relation between the amount of pressure applied to a load of washed articles to extract water therefrom and the length of time for which the pressure is applied in the device shown in FIG. 1.

When the piston rod 51 has been lowered, the load of washed articles 60 first receives a first preliminary water extracting pressure which is as low as, say, a maximum of 0.5 kg/cm$^2$, for a period of time $T_1$ of, say, at least five seconds. The pressure is gradually raised to a second preliminary pressure or a medium pressure of, say, a maximum of 7.0 kg/cm$^2$, as shown in FIG. 2. The medium pressure is applied for such a period of time $T_2$ that $T_1$ and $T_2$ may be a total of at least 10 seconds. This pressure application has been experimentally found important to protect the load of washed articles 60 against damage.

Figure 18:
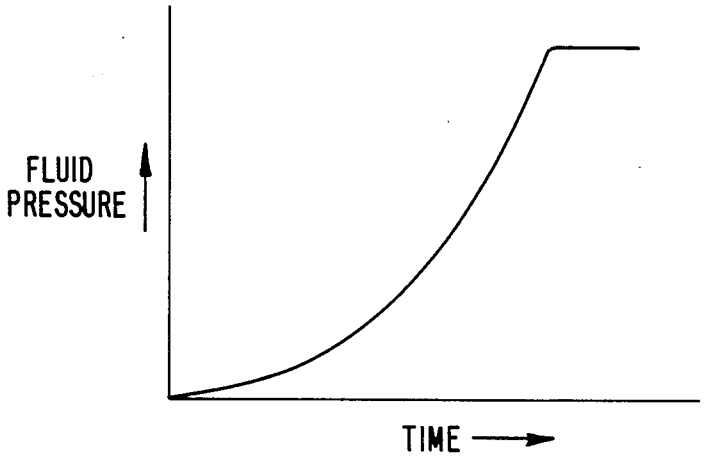
FIG. 18 is a graph similar to FIG. 2, but showing the pressure-time relation in the conventional device.

If the delivery pressure of the pump were directly employed for extracting water from the load of washed articles 60 as is the case with the conventional device (FIG. 18), the load of washed articles 60 would suddenly receive a high pressure and the air and water which the load 60 contains would produce a strong force which would tear it or make a circular hole or holes therein. Therefore, the preliminary extraction of water as hereinabove described is very important for protecting the articles.

The supply of the hydraulic fluid 66 is continued to continue the application of pressure to the load 60 until the pressure reaches a predetermined maximum level. If the predetermined maximum pressure is reached, the pressure controller 61 transmits a signal to the servo valve 63 to actuate it to bypass the hydraulic fluid 66 to cause it to flow back into the reservoir 65 through the return line 64 so that an appropriate level of pressure may be maintained throughout the water extracting operation. The pressure controller 61 can be set for actuation at different levels of maximum pressure which depend on the nature of the load of washed articles 60.

Figure 5:
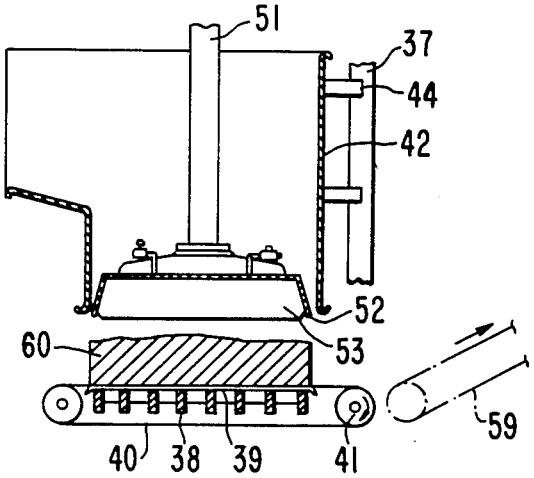

The timer not shown is set for realizing a proper cycle of the water extracting operation. Upon expiration of the time set by the timer, the hydraulic system 48 is switched to a different circuit which causes the piston rod 51 to rise to some extent to its intermediate position as shown in FIG. 5, or to its uppermost position, whereupon the membrane 53 is separated from the washing 60. The basket raising and lowering mechanism 46 is actuated to raise the basket 42 by the chain, etc., as shown in FIG. 5. A limit switch or similar device not shown detects the upward movement of the basket 42 and transmits a signal which causes the driving roll 41 to rotate in the direction of an arrow in FIG. 5. The rotating roll 41 causes the belt 40 to move in the same direction to transfer the load 60, from which water has been extracted, onto the conveyor 59, so that it may be conveyed to a drying machine not shown.

An appropriate device not shown, such as a timer or a photoelectric device, detects the complete transfer of the washing 60 onto the conveyor 59 and transmits a signal wich causes the roll 41 to stop its rotation. When the roll 41 has stopped its rotation, an appropriate signal is transmitted to lower the basket 42 onto the belt 40 and to raise the piston rod 51, whereby the device is returned to its initial position as shown in FIG. 3. A limit switch or similar device not shown detects the upward retraction of the piston rod 51 and outputs a signal which allows a new load 60 to be supplied from the washing machine 58 to the basket 42. The foregoing cycle of operation is thereafter repeated.

Figure 6:
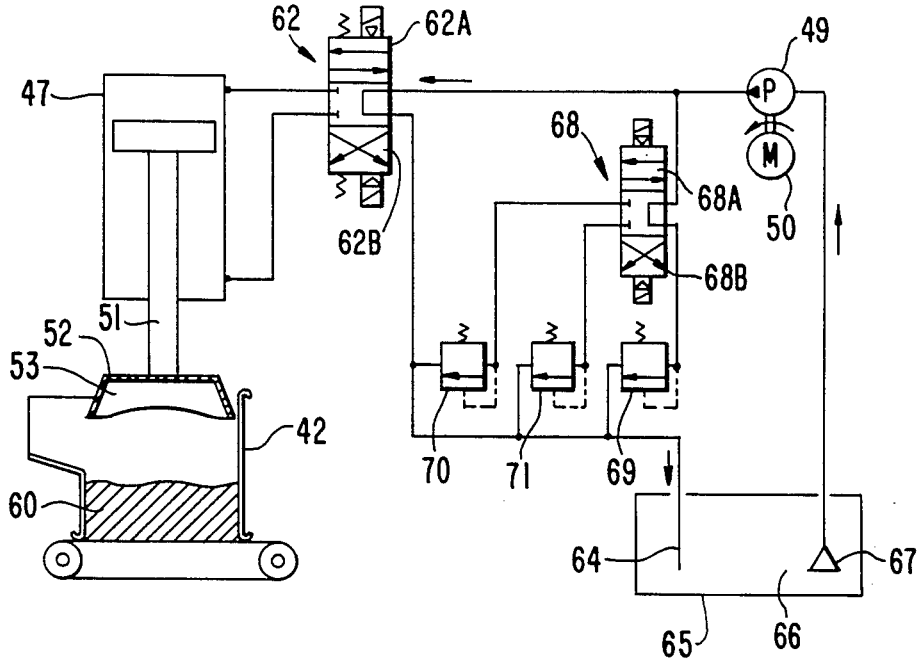
FIG. 6 is a diagram showing a hydraulic circuit in a device according to a second embodiment of this invention.

(2) Second Embodiment:

The second embodiment of this invention is shown in FIG. 6. It includes a number of features which differentiate it from the first embodiment shown in FIG. 1. Only the differences will hereinafter be described. An electromagnetic pressure control valve 68 is provided in place of the servo valve 63 in FIG. 1. The valve 68 has an upper portion 68A which can be positioned in the fluid circuit for supplying the hydraulic fluid 66 at a low pressure, and a lower portion 68B which can be positioned in the fluid circuit for supplying it at a medium pressure, whereby the preliminary extraction of water from the washing 60 can be accomplished. The upper portion 68A is first energized. If it is energized, the pressure of the hydraulic fluid 66 which is delivered by the pump 49 rises to a level set by a low pressure relief valve 70. If its pressure further increases, the fluid 66 is returned into the reservoir 65 through the relief valve 70 and the return line 64, so that the pressure applied to the load of washed articles 60 by the piston rod 51 may be maintained at a predetermined low level.

Then, if the lower portion 68B of the valve 68 is positioned in the fluid circuit, the pressure of the fluid 66 rises to a medium level set by a medium pressure relief valve 71. If its pressure further increases, the fluid 66 is returned into the reservoir 65 through the relief valve 71 and the return line 64, so that the pressure applied to the load of washed articles 60 by the piston rod 51 may be maintained at a predetermined medium level.

A high pressure relief valve 69 is provided for setting a maximum level of pressure which the fluid 66 being supplied from the pump 49 to the cylinder 47 can reach after the preliminary extraction of water from the load of washed articles 60. If the maximum pressure is reached, the relief valve 69 functions to return the fluid 66 into the reservoir 65 through the return line 64 to prevent any fluid having a higher pressure from being supplied into the cylinder 47.

The low pressure portion 68A of the valve 68 is energized when the application of pressure to the load of washed articles 60 is started. It remains energized for a certain period of time set by a timer not shown. The low pressure relief valve 70 remains open as long as the low pressure portion 68A remains energized. Upon lapse of the time set by the timer, the low pressure portion 68A is deenergized and the medium pressure portion 68B of the valve 68 is energized. The medium pressure relief valve 71 is now opened, while the low pressure relief valve 70 is closed. The medium pressure portion 68B remains energized for a certain period of time set by a timer not shown. If it is thereafter deenergized, the valve 68 is brought to its neutral position and the low and medium pressure relief valves 70 and 71 are both closed. The pressure of the fluid 66 flowing into the cylinder 47 rises again until it reaches the maximum level set by the high pressure relief valve 69. Thus, the control valve 68 and the relief valves 69 to 71 define a mechanism which corrrespond to the pressure controller 61 and the servo valve 63 in FIG. 1.

The low pressure to which the fluid is controlled by the low pressure portion 68A of the valve 68 is preferably not higher than 0.5 $kg/cm^2$, and is preferably maintained for a period of at least five seconds. The medium pressure to which the fluid is controlled by the medium pressure portion 68B is preferably not higher than 7.0 $kg/cm^2$, and is preferably maintained for a period of at least five seconds, too. The maximum pressure set by the high pressure relief valve 69 is, for example, 35 $kg/cm^2$.

The maximum pressure, however, has to be set to a level of, say, 10 to 20 $kg/cm^2$, as shown by a broken line in FIG. 2, if the load is a mixture of cotton and polyester, or of hemp articles. The same is true of the device according to the first embodiment of this invention. This control of the maximum pressure can be easily attained by means of the pressure controller 61 in the device according to the first embodiment, or if an appropriate combination of a relief valve and an electromagnetic valve is added to the device according to the second embodiment.

Figure 7:
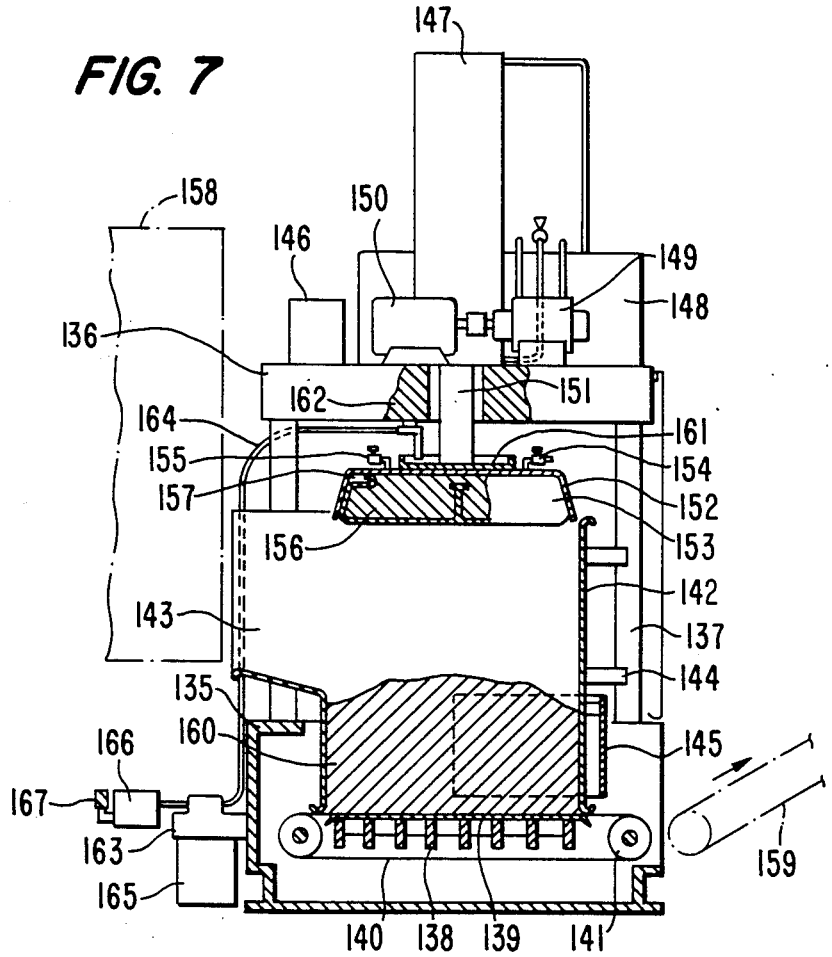
FIG. 7 is a detailed side elevational view, partly in section, of a device according to a third embodiment of this invention.
Figure 8:
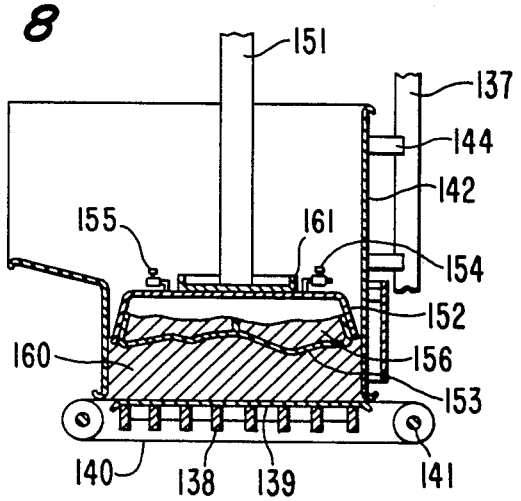
FIGS. 8 and 9 are fragmentary side elevational views, partly in section, showing the device of FIG. 7 in different operating positions.
Figure 9:
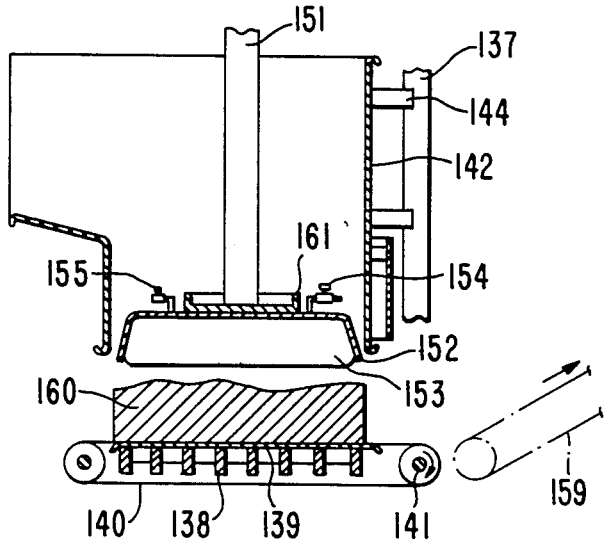

(3) Third Embodiment:

The third embodiment of this invention is shown in FIGS. 7 to 9. A substructure 135 is mounted on a floor. A superstructure 136 is connected to the substructure 135 by a plurality of pillars 137. A lattice deck 138 is secured to the substructure 135 and carries a perforated deck plate 139. An endless belt 140 having a relatively large width extends between a pair of rolls 141, of which one is a driving roll. The belt 140 is perforated or is fabricated from a to allow water to pass therethrough.

A basket 142 is made of a perforated plate and has a cylindrical lower portion adapted to hold a load of washed articles therein. The basket 142 has a top opening 143 through which articles can be introduced into its lower portion. A plurality of guide members 144 project from the basket 142 and engage the pillars 137. A skirt 145 is provided about the lower portion of the basket 142. A device 146 for raising and lowering the basket 142 is secured to the superstructure 136 and is connected to the basket 142 by a chain or the like. A hydraulic cylinder 147 is secured to the superstructure 136 and includes a piston rod 151. A hydraulic system 148 includes a fluid reservoir and a hydraulic circuit for supplying a hydraulic fluid to the hydraulic cylinder 147. A hydraulic pump 149 is provided for the hydraulic system 148 and a motor 150 is provided for driving the pump 149.

The piston rod 151 carries a bowl-shaped member 152 at its lower end. An elastic membrane 153 closes the opening of the bowl-shaped member 152 so that the latter may hold water 156 or other liquid therein. A member 154 for supplying water and a member 155 for discharging air are connected to the bowl-shaped member 152. The membrane 153 is secured to the bowl-shaped member 152 by a ring 157 which is bolted to the latter. A continuous washing machine is shown at 158. A conveyor 159 is provided for delivering to a drying machine, etc. washing 160 from which water has been extracted by the device of this invention. A fluid receptacle 161 is secured to the piston rod 151 and provided on the bowl-shaped member 152. A nozzle 162 is secured to the superstructure 136 for drawing a hydraulic fluid and water from the fluid receptacle 161.

A filter 163 is secured to the substructure 135 for separating the liquid and gas flowing from the nozzle 162 through a hose 164. A bottle 165 is removably attached to the filter 163 for collecting the liquid which has been separated from the gas. The gas is drawn by a vacuum pump 166 attached to the filter 163 and is discharged to the atmosphere through a muffler 167 attached to the vacuum pump 166.

In operation, the basket 142 staying in its lowered position receives the load of washed articles 160 from the washing machine 158, while the belt 140 is out of operation and the piston rod 151 is in its raised position, as shown in FIG. 7. The skirt 145 prevents the scattering of water flowing out of the basket 142 or even the outflow of water therefrom which is likely to cause the displacement of the load 160 to one side of the basket 142.

The hydraulic system 148 is actuated in response to a signal from the washing machine 158 indicating that it has supplied the basket 142 with an appropriate amount of washed articles 160. The piston rod 151 is lowered and causes the membrane 153 to press the load of washed articles 160. FIG. 8 shows the position of the device in which the piston rod 151 has ceased to be lowered when a balance of pressure has been reached between the piston rod 151 and the load 160. The application of pressure is started slowly to discharge air from the load of washed articles 160 and thereby protect it against damage. The piston rod 151 continues the application of pressure for as long a time as is required for extracting water from the load.

A timer not shown is set for achieving a proper cycle of the water extracting operation. Upon expiration of the time set by the timer, the hydraulic system 148 is switched to establish a different circuit connection to raise the piston rod 151 to some extent to its intermediate position as shown in FIG. 9, or to its uppermost position, whereupon the membrane 153 is separated from the load 160. In response to a signal from a timer or similar device not shown, the basket raising and lowering mechanism 146 is actuated to raise the basket 142 by the chain, etc. as shown in FIG. 9. A limit switch or similar device not shown detects the upward movement of the basket 142 and outputs a signal to cause the driving roll 141 to rotate in the direction of the arrow shown in FIG. 9. The belt 140 is moved in the same direction and transfers the load 160 onto the conveyor 159 which will in turn carry it to a drying machine of other device not shown.

An appropriate device not shown, such as a timer or photoelectric device, detects the complete transfer of the load 160 to the conveyor 159 and transmits a signal which causes the driving roll 141 to stop its rotation. Then, the basket 142 is lowered onto the belt 140 and the piston rod 151 is raised to its uppermost position, as shown in FIG. 7. A limit switch or similar device not shown detects the upward retraction of the piston rod 151 and transmits a signal which allows the washing machine 158 to supply a new load of washed articles 160 into the basket 142. The foregoing cycle of operation is, thereafter, repeated. Each cycle of operation has a period of 1.5 to 2 minutes.

The hydraulic fluid adhering to the piston rod 151 as a result of the repeated operation drops and gradually gathers in the fluid receptacle 161. When the piston rod 151 is in its lowered position as shown in FIG. 8, the water scattering from the washing machine 158 is likely to adhere to the piston rod 151 and drop into the receptacle 161. Thus, a mixture of the hydraulic fluid and water is likely to collect in the receptacle 161. When the piston rod 151 has been raised as shown in FIG. 7, the limit switch or similar device not shown detects it and transmits a signal to start the vacuum pump 166.

As a result, a negative pressure is produced in the filter 163, bottle 165, hose 164 and nozzle 162. The negative pressure draws the mixed liquid from the fluid receptacle 161 through the nozzle 162 having its lower end dipped in the mixed liquid as shown in FIG. 7. The liquid is caused to flow through the hose 164 and the filter 163 into the bottle 165. The operation of the vacuum pump 166 is stopped when the piston rod 151 has been lowered to start the application of pressure to the load of washed articles 160.

The device of this invention protects the load from contamination by the hydraulic fluid. Its maintenance is very easy, as the mixed liquid is automatically discharged from the fluid receptacle.

Figure 10:
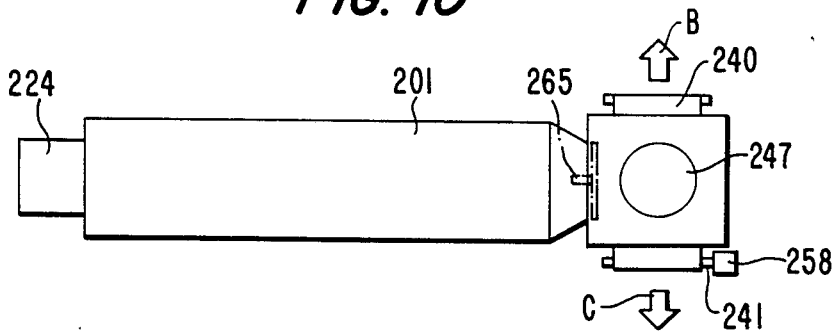
FIG. 10 is a schematic top plan view of a continuous washing machine equipped with a device according to a fourth embodiment of this invention.
Figure 11:
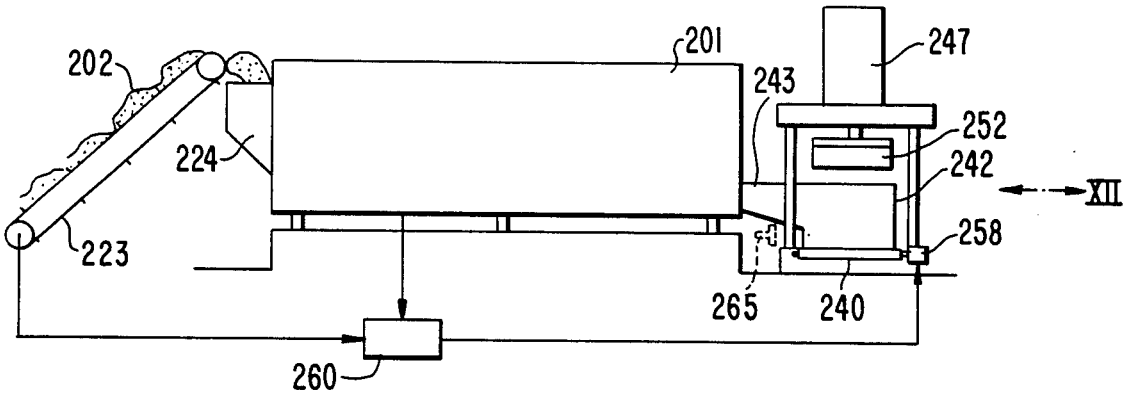
FIG. 11 is a side elevational view of FIG. 10.
Figure 12:
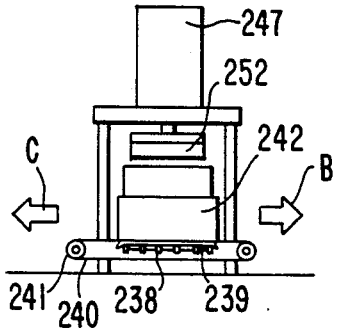
FIG. 12 is an end view taken in the direction of an arrow XII in FIG. 11.

(4) Fourth Embodiment:

The fourth embodiment of this invention is shown in FIGS. 10 to 15. The device of this invention is connected to a continuous washing machine 201 as shown in FIGS. 10 and 11. The device is supported on a substructure 236 mounted on a floor. The substructure 236 is provided with a plurality of pillars 237. A lattice deck 238 is secured to the substructure 236 and carries a perforated deck plate 239. An endless belt 240 having a relatively large width extends between a pair of rolls 241, of which one is a driving roll. The belt 240 is perforated or is fabricated from a network to allow water to pass therethrough.

A basket 242 is made of a perforated plate and has a cylindrical lower portion. The basket 242 has a top opening 243 through which a load of washed articles 202 can be introduced into its lower portion. A plurality of guide members 244 project from the basket 242 and engage the pillars 237. A skirt 245 is provided about the lower portion of the basket 242. A mechanism 246 for raising or lowering the basket 242 is secured to the substructure 236 and connected to the basket 242 by a chain, etc. A hydraulic cylinder 247 is secured to the substructure 236 and includes a piston rod 251. A hydraulic system 248 includes a fluid reservoir and a hydraulic circuit for supplying a hydraulic fluid to the cylinder 247. A hydraulic pump 249 is provided for the hydraulic system 248. A motor 250 is provided for driving the pump 249.

The piston rod 251 carries a bowl-shaped member 252 at its lower end. An elastic membrane 253 closes the opening of the bowl-shaped member 252 so that the latter may hold water therein. A member 254 for supplying water and a member 255 for discharging air are connected to the bowl-shaped member 252. The membrane 253 is secured to the bowl-shaped member 252 by a ring 257 which is bolted to the latter. The water 256 is held between the bowl-shaped member 252 and the membrane 253.

A motor 258 is connected to the driving roll 241 as shown in FIGS. 10 and 11. The motor 258 is rotatable in two opposite directions for rotating the endless belt 240 in the direction of arrows B or C in FIG. 10.

A conveyor 223 is provided in front of the entrance of the washing machine 201. An operation control unit 260 is operationally connected to the washing machine 201, conveyor 223 and motor 258, as shown in FIG. 11. Various data are inputted to the control unit 260 so that it may determine the direction of rotation of the motor 258 to cause the endless belt 240 to rotate in the direction of the arrow B or C. The data include the kinds or articles 202 to be introduced into the washing machine 201, the order in which they are introduced, and the rotating angle and frequency of a drum in the washing machine 201.

Figure 13:
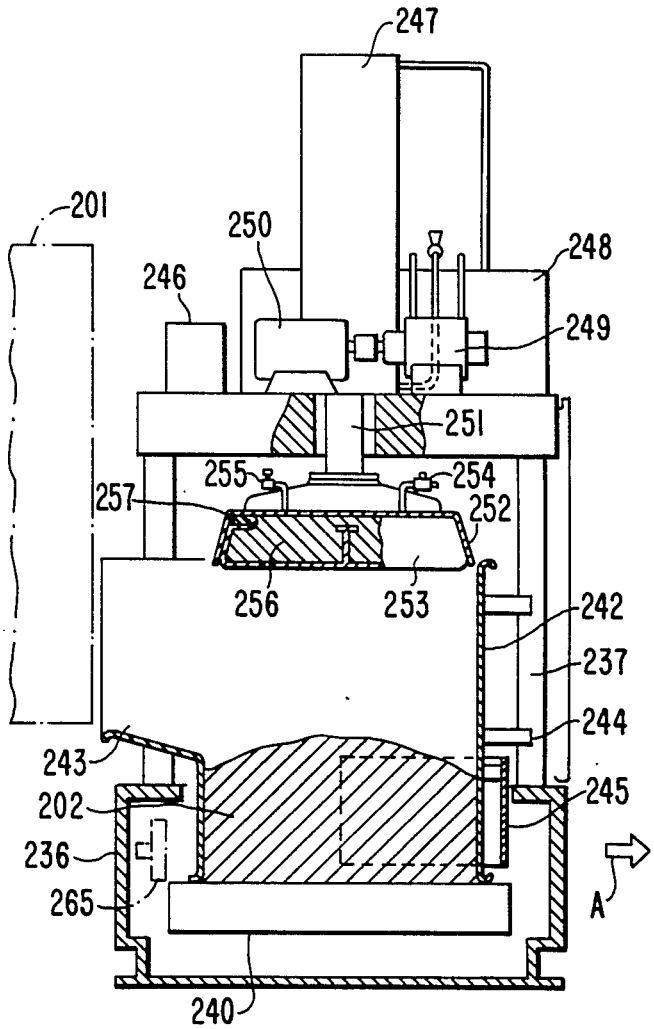
FIG. 13 is a detailed side elevational view, partly in section, of the device according to the fourth embodiment of this invention.

In operation, the articles 202 to be washed are classified into different kinds, such as bed sheets, towels and bathrobes and placed on the conveyor 223. The kinds of articles 202 and the order in which they lie on the conveyor 223 are inputted to the operation control unit 260 by an enter key not shown. The articles 202 are progressively supplied from the conveyor 223 into the washing machine 201 through its entrance 224, washed for a predetermined length of time and delivered from the exit of the washing machine 201 into the basket 242 staying in its lowered position, while the belt 240 is out of operation and the piston rod 251 is in its raised position, as shown in FIG. 13. When the articles 202 are supplied into the basket 242, the skirt 245 prevents the scattering of water flowing out of the basket 242 and even the outflow of water from the basket 242 which would cause the undesirable displacement of the articles 202 to one side of the basket 242.

Figure 14:
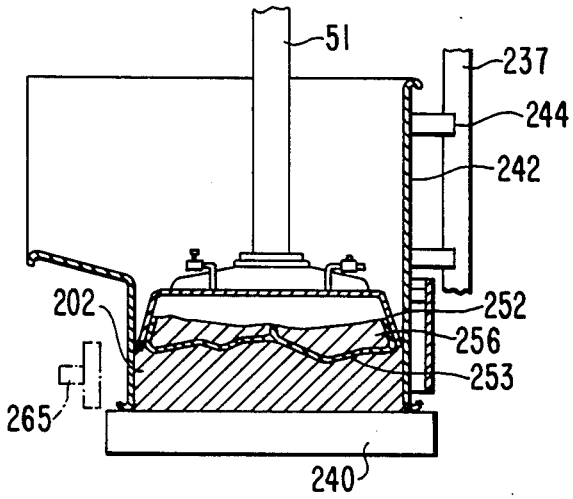
FIGS. 14 and 15 are fragmentary side elevational views, partly in section, showing the device of FIG. 13 in different operating positions.

In response to a signal from the washing machine 201 indicating its delivery of the load of washed articles 202 into the basket 242, the operation control unit 260 actuates the hydraulic system 248 to lower the piston rod 251 and cause the membrane 253 to press the load 202. FIG. 14 shows the position of the device in which the piston rod 251 has ceased to be lowered when a balance of pressure has been reached between the load 202 and the piston rod 251. The application of pressure is started slowly to discharge air from the load of washed articles 202 to protect is against damage. The piston rod 251 continues the application of pressure for as long a time as is required for extracting water from the load of washed articles 202.

Figure 15:
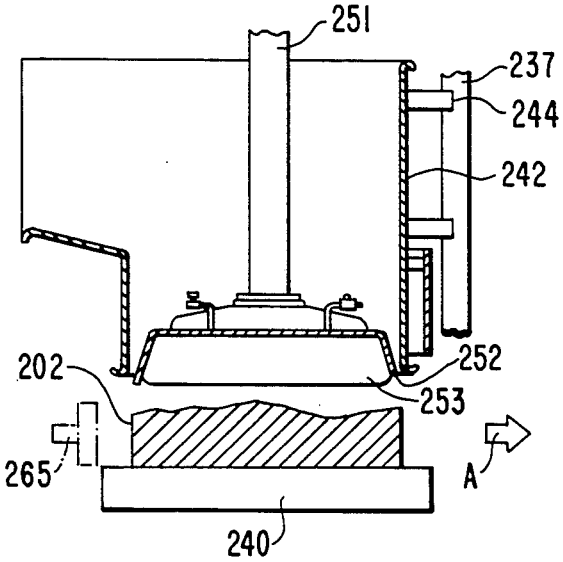

A timer not shown is set for achieving a proper cycle of the water extracting operation. Upon expiration of the time set by the timer, the hydraulic system 248 is switched to establish a different circuit connection to raise the piston rod 251 to some extent to its intermediate position as shown in FIG. 15, or to its uppermost position, whereupon the membrane 253 is separated from the load 202. This is effected by a timer or similar device not shown and in response to a signal therefrom, the basket raising and lowering mechanism 246 is actuated to raise the basket 242 by the chain, etc. as shown in FIG. 15. A limit switch or similar device not shown outputs a signal indicating that the basket 242 has been raised. This signal and a signal from the operation control unit 260 are transmitted to the motor 258 to cause the driving roll 241 to rotate in either direction to carry the load of washed articles 202 in the direction of either arrow B or C. The load 202 is, then, transferred to a drying machine or other device.

An appropriate device not shown, such as a timer or photoelectric device, detects the transfer of the load 202 from the belt 240 and outputs a signal which causes the driving roll 241 to stop its rotation. When the rotation of the roll 241 has been stopped, the basket 242 is lowered onto the belt 240 and the piston rod 251 is raised, as shown in FIG. 13. A limit switch or similar device not shown detects the upward retraction of the piston rod 251 and outputs a signal which allows the washing machine 201 to supply the basket 242 with another load of washed articles 202. The foregoing sequence of operation is thereafter repeated.

Figure 16:
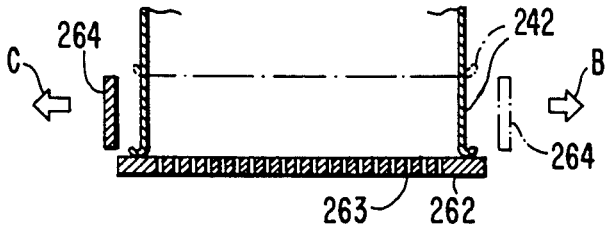
FIG. 16 is a fragmentary sectional view showing a modified arrangement for an apparatus for convveying a load of washed articles according to the present invention.
Figure 17:
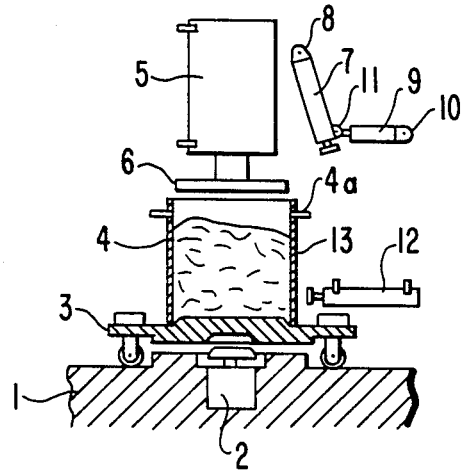
FIG. 17 is a schematic side elevational view, partly in section, of the conventional device which has hereinbefore been described.

Attention is directed to FIG. 16 showing a different arrangement for conveying the load 202. It includes a supporting plate 262 which replaces the deck 238 and the deck plate 239. The supporting plate 262 is secured to the substructure 236 and has a plurality of apertures 263 through which water can be discharged. A discharge plate 264 replaces the endless belt 240 and the rolls 241. It is located above the supporting plate 262 and is reciprocatively movable along the supporting plate 262 by a driving unit not shown. The driving unit is responsive to a signal from the operation control unit 260 to move the discharge plate 264 in either direction to discharge the load from the supporting plate 262 in the direction of either arrow B or C.

Although the load has been described as being discharged in either of the two directions B and C perpendicularly to the machine, it is also possible to discharge it in another direction longitudinally of the machine as shown by arrow A in FIGS. 13 and 15. A discharge plate 265 is, therefore, provided reciprocatively movable by a driving unit not shown longitudinally of the washing machine 201, as shown in FIGS. 10, 11 and 13 to 15. The driving unit is responsive to a signal from the operation control unit 260 to enable the transfer of the load by the discharge plate 265 in the direction of the arrow A, while the belt 240 driven by the motor 258 conveys the load in either of the two directions B and C. The discharge plate 265 can, of course, be incorporated into the arrangement of FIG. 16, too.

The device of this invention as hereinabove described eliminates the necessity of employing an expensive conveyor having a turning device for delivering the load in a plurality of directions. It is compact in construction and requires only a small space for installation. It can be installed even in a small washing factory. The direction in which the load is delivered from the device of this invention can be automatically controlled in accordance with the kinds of articles to be introduced into the washing machine and the order in which they are washed therein, as hereinabove described. This feature contributes to reducing the amount of labor required for the operation of the device.

What is claimed is:

1. A device for extracting water from a load of washed articles, said device comprising:

a basket in which the load is confined;

fluid pressure exerting means employing fluid pressure for causing the fluid pressure to exert pressure on the load confined within said basket for extracting water therefrom; and a control system operatively connected to said fluid pressure exerting means for controlling the fluid pressure exerted by said fluid pressure exerting means on the load of washed articles confined within the basket, said control system causing said fluid pressure exerting means to initially exert a first low pressure on the load for a predetermined period of time, and said control system causing said fluid pressure exerting means to exert a second pressure on the load that is higher than said first pressure after said predetermined period of time has elapsed, said first pressure being at the most approximately 0.5 $kg/cm^2$ in order that the load of washed articles be preliminary compressed at said first low pressure during initial extraction of water from the load over said predetermined period of time to prevent damage to the articles by water and any air trapped in the load.

2. A device as claimed in claim 1, wherein said fluid pressure exerting means comprises a piston rod, a hydraulic cylinder connected with one end of said piston rod for extending and retracting said piston rod into and from said basket respectively, a bowl-shaped fluid receptacle fixed to the other end of said piston rod, a membrane fixed over said bowl-shaped fluid receptacle for engaging the load confined within the basket when water is extracted therefrom, and fluid supply means for supplying fluid to said fluid receptacle which exerts pressure on said membrane.

3. A device as claimed in claim 1, and further comprising conveyor means adjacent said basket and movable in at least two directions for transporting the load after water has been extracted therefrom; and control means for controlling said conveyor means to selectively transport the load in one of said at least two directions after water has been extracted therefrom.

4. A device as claimed in claim 1, wherein said fluid pressure exerting means comprises a piston rod, a hydraulic cylinder connected with one end of said piston rod for extending and retracting said piston rod into and from said basket respectively, a bowl-shaped fluid receptacle fixed to the other end of said piston rod, a membrane fixed over said bowl-shaped fluid receptacle for engaging the load confined within the basket when water is extracted therefrom, and fluid supply means for supplying fluid to said fluid receptacle which exerts pressure on said membrane; and further comprising conveyor means adjacent said basket and movable in at least two directions for transporting the load after water has been extracted therefrom; and control means for controlling said conveyor means to selectively transport the load in one of said at least two directions after water has been extracted therefrom.

* * * * *